US006389242B1

(12) United States Patent
Watanabe

(10) Patent No.: US 6,389,242 B1
(45) Date of Patent: May 14, 2002

(54) IMAGE FORMING APPARATUS AND IMAGE FORMING METHOD

(75) Inventor: Takeshi Watanabe, Ichikawa (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/662,829

(22) Filed: Sep. 15, 2000

(51) Int. Cl.[7] ..... G03G 15/00

(52) U.S. Cl. ..... 399/45; 399/237; 399/308; 399/318

(58) Field of Search ..... 399/38, 45, 57, 399/66, 237, 251, 297, 298, 302, 308, 313, 318

(56) References Cited

U.S. PATENT DOCUMENTS 5,708,938 A 1/1998 Takeuchi et al. ..... 399/250
6,002,891 A * 12/1999 Shin ..... 399/45

FOREIGN PATENT DOCUMENTS

JP 8-254907 10/1996

* cited by examiner

*Primary Examiner*—Sophia S. Chen
*Assistant Examiner*—Hoan Tran
(74) *Attorney, Agent, or Firm*—Foley & Lardner

(57) ABSTRACT

An image forming apparatus of this invention includes an exposure unit for forming an electrostatic latent image on a photosensitive drum, a developing device for developing the electrostatic latent image on the photosensitive drum with a developing solution obtained by dispersing developer particles in a solvent, thereby forming a visible image, an intermediate transfer medium abutted against the photosensitive drum to transfer the visible image on the photosensitive drum thereto, a transfer unit having a backup member abutted against the intermediate transfer medium, the backup member urging a sheet against the intermediate transfer medium, thereby transferring a toner image on the intermediate transfer medium to the sheet, a detection unit for determining a type of the sheet to which the toner image is to be transferred by the transfer unit, and a control device for variably controlling a pressing force applied by the backup member to the sheet in accordance with the type of the sheet determined by the detection unit.

31 Claims, 10 Drawing Sheets

IMAGE FORMING APPARATUS AND IMAGE FORMING METHOD

BACKGROUND OF THE INVENTION

The present invention relates to a wet image forming apparatus employed as, e.g., an electrophotographing apparatus or electrostatic recording apparatus, to form an image by using a liquid developer.

A wet image forming apparatus of this type has advantages that cannot be realized by a dry image forming apparatus, and its value has received attention in recent years. More specifically, since the wet image forming apparatus can use toner with very fine particles on the submicron order, it can realize high image quality. This apparatus is economical since a sufficiently high image density can be obtained with a small amount of toner, while achieving quality equivalent to that of a print.

A conventional wet image forming apparatus using liquid toner has several problems that allowed the dry type technique to dominate the market. One of the problems occurs in transferring a toner image.

The major problem in transfer is degradation in image quality. Conventionally, since a toner image attached to the image carrier is directly transferred by a transfer unit to a sheet with an electric field, transfer nonuniformity occurs due to variations in electric field corresponding to the unevenness on the surface of the sheet. Also, defective transfer tends to occur due to variations in electric characteristics of the sheet and environment dependency, thus greatly degrading the image quality of the transfer image.

In order to solve this problem, Jpn. Pat. Appln. KOKAI Publication No. 8-254907 discloses an apparatus in which a pressing force applied during transfer with an electric field from the image carrier to the sheet is changed in accordance with the type of the sheet or by changing a transfer nip width.

With this apparatus, even if unevenness on the sheet or the absorption for the solvent changes, a sufficiently large amount of carrier liquid is kept filled between the sheet and image carrier by adjusting the pressing force for the sheet, so that good transfer is enabled.

In this case, the sheet and the image carrier are, strictly speaking, out of mutual contact because the pressing force must be adjusted such that an appropriate amount of carrier liquid is present between the sheet and image carrier. Further, even if the sheet and the image carrier contact each other, the pressing force for the sheet and image carrier is 1 kgf or less in the whole transfer nip, which is equivalent to a pressure of less than 250 g/cm$^2$.

This method has limitations and cannot assure a high image quality for all sheet types. More specifically, the surface roughness of plain paper and the like changes depending on surface portions, and the absorption for the solvent and the like are very unstable. Therefore, improvement in image quality is limited.

A large number of apparatuses have been proposed that do not transfer an image with an electric field directly from the image carrier to the sheet but transfer it from the image carrier to an intermediate transfer medium once and then to the sheet. U.S. Pat. Nos. 5,148,222, 5,166,734, 5,208,637, and the like disclose apparatuses that transfer a toner image from an image carrier to an intermediate transfer medium with an electric field (to be referred to as primary transfer hereinafter) and after that transfer the toner image from the intermediate transfer medium to a sheet with a pressure (and heat) (to be referred to as secondary transfer hereinafter).

Jpn. Pat. Appln. KOKOKU Publication No. 46-41679, Jpn. Pat. Appln. KOKAI Publication No. 62-280882, and the like disclose apparatuses that do not employ electric field transfer but employs pressure (and heat) in both primary transfer of the toner image from the image carrier to the intermediate transfer medium and secondary transfer of the toner image from the intermediate transfer medium to the sheet.

In these cases, secondary transfer of the toner image from the intermediate transfer body to the sheet is achieved by heat and pressure. An image of very high quality can therefore be obtained. However, a necessary transfer load largely changes, depending on the types of sheets, particularly the surface roughness of each sheet.

A load necessary for transfer can be small if the sheet is art paper with a smooth surface or special paper coated with a material having good adhesion with the toner image in advance. When, however, a toner image is to be printed on plain paper, tissue paper, or the like, a very large load is required.

Generally, the surface roughness of paper can be measured by the JIS-B0601 method. Measured by this method at ten point on the or an ordinary paper sheet, the average surface roughness (Rz) of the sheet ranges about 14 $\mu$m to 30 $\mu$m, and the center-line average roughness is about 2 to 4 $\mu$m. Tissue paper has a larger surface roughness than the ordinary paper. By contrast, art paper has a ten-point average surface roughness (Rz) of 10 $\mu$m or less in most cases, and its center-line average roughness (Ra) is 1.5 $\mu$m or less. Like art paper, film such as an OHP sheet has a smaller surface roughness than the ordinary paper. If the sheet is art paper or the like on which the toner image can be transferred easily, the pressing contact force for the intermediate transfer body and sheet can be 1 kgf to 20 kgf (corresponding to a pressure of approximately 0.25 kg/cm$^2$ to 5 kg/cm$^2$), and if the sheet is plain paper or the like, a high pressure of 20 kgf to 200 kgf (corresponding to a pressure of 5 kg/cm$^2$ to 50 kg/cm$^2$) is required.

Conventionally, secondary transfer is performed with a high load regardless of the types of sheets, that is, whether the sheet is plain paper or art paper. Accordingly, a large load is continuously applied to the intermediate transfer medium to shorten its service life. A damage is also large when paper jamming or the like occurs.

This tendency is more typical in the transfer method that performs primary transfer of the toner image from the image carrier to the intermediate body with a pressure, because only a small degree of freedom is allowed for the design of the intermediate body and a highly durable intermediate transfer body is accordingly difficult to form.

BRIEF SUMMARY OF THE INVENTION

The present invention has been made in view of the situations described above, and has its object to provide an image forming apparatus and image forming method in which the pressure is controlled so as to decrease the transfer load when a toner image is to be transferred to art paper or special paper which is processed in advance so that a toner image attaches to it easily, and so as to increase the transfer load when the toner image is to be transferred to a sheet with a poor surface smoothness such as plain paper, so that the intermediate transfer medium will not be damaged.

In secondary transfer of the toner image from the intermediate transfer medium to the sheet, the toner image is fused by applying heat. Hence, the longer the transfer time, the more advantageous for transfer.

It is, therefore, another object of the present invention to provide an image forming apparatus in which, when a toner image is to be transferred to a sheet such as plain paper with a poor surface smoothness, the transfer speed is decreased or the transfer nip width is widened, so that good transfer can be performed even if the type of the sheet changes.

An idea similar to the present invention is already disclosed in a fixing apparatus and the like in dry electrophotography. Generally, when the sheet is an OHP sheet, the toner must be dissolved sufficiently to render color. To cope with this, the fixing speed is often decreased to be lower than that for plain paper. Jpn. Pat. Appln. KOKAI Publication No. 7-325511 and the like exemplify this.

An example in which the transfer conditions are controlled by detecting the type of the sheet includes Jpn. Pat. Appln. KOKAI Publication No. 9-96942. In this example, if the sheet is an OHP sheet or the like, transfer is performed with transfer conditions different from those for plain paper.

These inventions are based on the premise that they deal with an OHP sheet, and they do not deal with the unevenness on the sheet or surface treatment. These inventions are not a solution considering the service life of the intermediate transfer body either, and have a purpose completely different from that of the present invention, as a matter of course.

In secondary transfer of the toner image from the intermediate transfer medium to the sheet with the pressure or heat and pressure employed in the present invention, even if a thin toner layer is to be transferred to a sheet with an uneven surface, the toner image cannot enter the recesses of the paper, and the lower the image density, the lower the transfer efficiency. This is the characteristic feature of wet electrophotography.

It is, therefore, still another object of the present invention to provide an image forming apparatus in which, when a toner image is to be printed on a sheet with a poor surface smoothness such as plain paper, the image density is intentionally increased so a low-density portion will not be formed in the toner image, thereby maintaining well the state of the image obtained by secondary transfer.

As an invention similar to the present invention, Jpn. Pat. Appln. KOKAI No. 8-254907 discloses an example in which the amount of toner attaching to the image carrier is controlled in accordance with the types of sheets.

This example relates to direct electric field transfer from the image carrier to the sheet, and aims at compensating for the transfer toner remained on the whole image, which cannot be sufficiently compensated for by adjusting the pressing force of the transfer unit, by changing the amount of toner attaching to the image carrier.

The present invention relates to pressure transfer and not electric field transfer. Exposure is controlled to be corrected so a low-density portion will not be formed in the toner layer. Therefore, the present invention is basically different from the disclosed examples.

Japanese Patent No. 2950414 and U.S. Pat. No. 6,002,891 discloses the technique of applying an appropriate transfer pressure, regardless of the thickness of the paper used, by detecting the thickness of the paper as the paper passes through the nip between guide rollers and by moving the backup roller up or down in accordance with the thickness detected. The technique has been invented to prevent application an undesirable pressure to the paper in the image-transferring process in the case where a thick paper sheet has passed the nip between the guide rollers. If such a pressure is applied to the paper, it will be applied via the intermediate transfer medium to the photosensitive image carrier, inevitably causing a trouble, such as deforming of the image, at the time of writing the latent image.

In the present invention, the thickness of the paper is not detected at all. Nor is the transfer pressure maintained at a constant value.

According to the present invention, there is provided an image forming apparatus comprising an image forming unit for forming an electrostatic latent image on an image carrier, a developing unit for developing the electrostatic latent image on the image carrier with a developing solution obtained by dispersing developer particles in a solvent, thereby forming a visible image, an intermediate transfer medium abutted against the image carrier to transfer the visible image on the image carrier thereto, a transfer unit having a backup member abutted against the intermediate transfer medium, the backup member urging a transfer target against the intermediate transfer medium, thereby transferring the visible image on the intermediate transfer medium to the transfer target, a determination unit for determining a type of the transfer target to which the visible image is to be transferred by the transfer unit, and a control unit for variably controlling a pressing force applied by the backup member to the transfer target in accordance with the type of the transfer target determined by the determination unit.

According to the present invention, there is also provided an image forming apparatus comprising an image forming unit for forming an electrostatic latent image on an image carrier, a developing unit for developing the electrostatic latent image on the image carrier with a developing solution obtained by dispersing developer particles in a solvent, thereby forming a visible image, an intermediate transfer medium to which the visible image on the image carrier is to be transferred, a transfer unit having a backup member abutted against the intermediate transfer medium, the backup member urging a transfer target against the intermediate transfer medium, thereby transferring the visible image on the intermediate transfer medium to the transfer target, a determination unit for determining a type of the transfer target to which the visible image is to be transferred by the transfer unit, and a control unit for variably controlling a contact time when the transfer target is in contact with the intermediate transfer medium in accordance with the type of the transfer target determined by the determination unit.

According to the present invention, there is also provided an image forming apparatus comprising an image forming unit for forming an electrostatic latent image on an image carrier, a developing unit for developing the electrostatic latent image on the image carrier with a developing solution obtained by dispersing developer particles in a solvent, thereby forming a visible image, an intermediate transfer medium to which the visible image on the image carrier is to be transferred, a transfer unit having a backup member abutted against the intermediate transfer medium, the backup member urging a transfer target against the intermediate transfer medium, thereby transferring the visible image on the intermediate transfer medium to the transfer target, a determination unit for determining a type of the transfer target to which the visible image is to be transferred by the transfer unit, and a control unit for controlling latent image forming operation of the image forming unit so as not to form a low-density image portion in the visible image in accordance with the type of the transfer target determined by the determination unit.

According to the present invention, there is also provided an image forming method comprising the steps of forming an electrostatic latent image on an image carrier, developing the electrostatic latent image on the image carrier with a developing solution obtained by dispersing developer particles in a solvent, thereby forming a visible image, transferring the visible image on the image carrier to an intermediate transfer medium abutted against the image carrier, urging a transfer target against the intermediate transfer medium with a backup member, thereby transferring the visible image on the intermediate transfer medium to the transfer target, determining a type of the transfer target to which the visible image is to be transferred, and variably controlling a pressing force applied by the backup member to the transfer target in accordance with the type of the transfer target determined by the determination unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present invention will be described with reference to the embodiments shown in the accompanying drawing.

Figure 1:
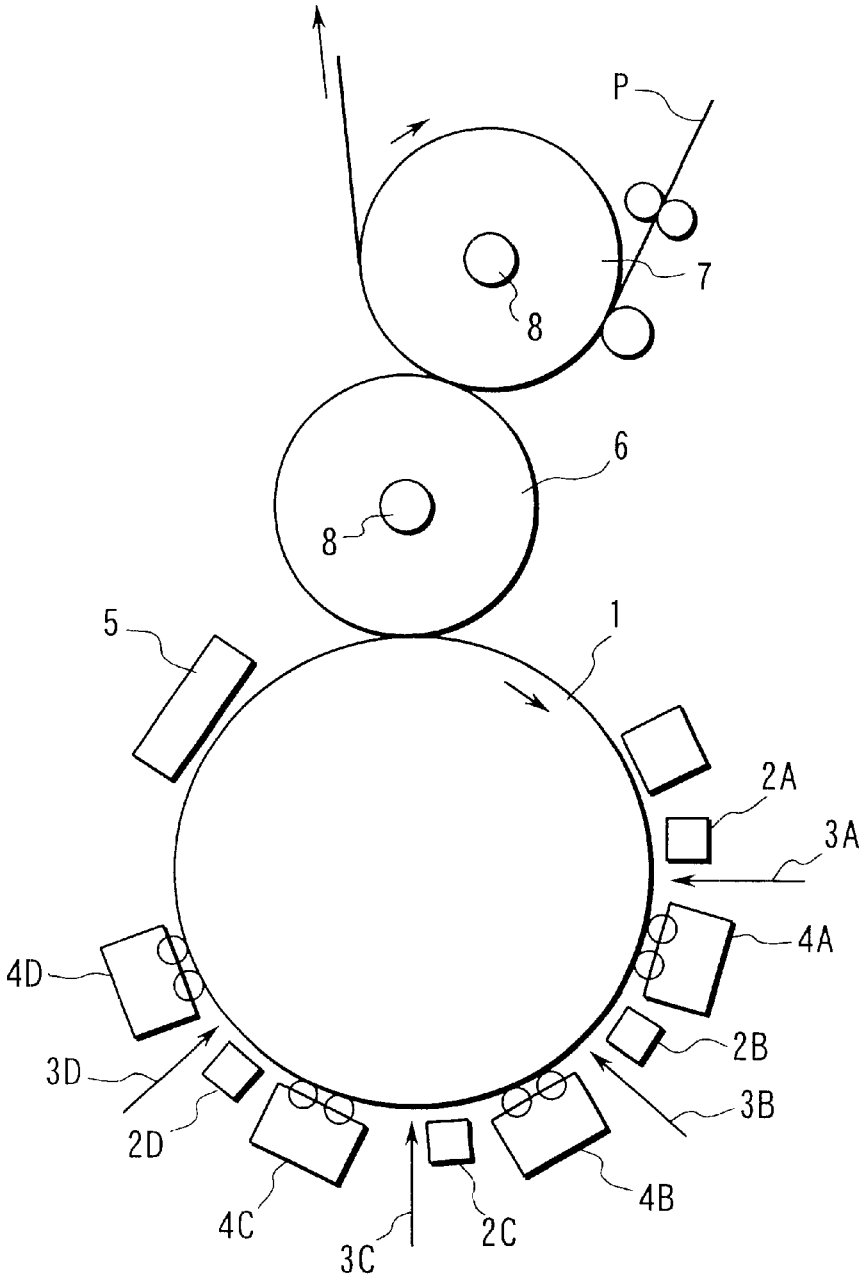
FIG. 1 is a view showing the arrangement of a wet electrophotographing apparatus according to an embodiment of the present invention.

FIG. 1 is a view showing the internal arrangement of a wet electrophotographing apparatus as an image forming apparatus according to one embodiment of the present invention.

Referring to FIG. 1, an organic- or amorphous silicon-based photosensitive layer is formed on a conductive base to form a photosensitive drum 1 serving as an image carrier. The surface of the photosensitive drum 1 is uniformly charged by a known corona or scorotron charger 2A and is subjected to exposure 3A by an image-modulated laser beam to form an electrostatic latent image. After that, the electrostatic latent image is visualized by a developing device 4A storing a liquid developer. As the liquid developer, for example, one obtained by dispersing metallic soap for charging control and a pigment-added acrylic resin or the like with a glass transition temperature (Tg) of −50° C. to 70° C. to a hydrocarbon-based insulating solvent, e.g., Isopar G, L, or M, or Norpar 12, 13, or 15 (Tradename) available from Exxon, can be used. The liquid developer or toner attaching to the electrostatic latent image may directly reach a pre-transfer dryer 5 to dry its solvent to a certain degree, and after that may be primarily transferred to an intermediate transfer medium 6. In this embodiment, however, the second electrostatic latent image is successively formed by a second charger 2B and second laser exposure 3B, and is developed by a second developing device 4B storing the second developer with a color different from that stored in the developing device 4A.

Therefore, after second development, a two-color toner image is formed on the image carrier 1. In the same manner, third and fourth charging, exposure, and development operations are performed to form a full-color toner image on the photosensitive drum 1.

After that, the toner image is dried by the dryer 5 to a certain degree, and is continuously transferred onto the intermediate transfer medium 6. The intermediate transfer medium 6 is formed by coating a metal roller with silicone rubber or urethane rubber to a thickness of 0.1 to 5 mm. The surface hardness of the intermediate transfer medium 6 is 1° to 70° (JIS-A).

Preferably, a silicone- or fluorine-based mold release layer is formed to a thickness of 0.1 $\mu$m to 5 $\mu$m, on the photosensitive layer provided on the photosensitive drum 1. The surface energy of the mold release layer is 15 dyne/cm to 30 dyne/cm when converted from a value measured from the contact angle of Isopar L and pure water. Nonetheless, no mold release layer may be formed on the photosensitive layer. Even in this case, an image can be transferred to the intermediate transfer medium only if the intermediate transfer medium is one that serve this purpose.

To prepare the liquid toner, an acrylate-based copolymer, a dispersant, and the like were added to Isopar L. The resultant mixture was mixed and dispersed in a paint shaker in the presence of glass beads, thereby preparing a condensed liquid developer. The obtained condensed developer was diluted with Isopar L such that the concentration of its nonvolatile component became 1 wt %. Fifty wt % of zirconium naphthenate (with a nonvolatile component of 49 wt %) manufactured by DAINIPPON INK & CHEMICALS, INC. was added to the nonvolatile component of the liquid developer described above.

As the pigment to be added to the toner particles, for example, if the toner is cyan toner, Cyanin Blue KRO manufactured by SANYO COLOR WORKS, Ltd. was used, and the weight ratio of the resin to the pigment was set to 4:1. The glass transition temperature of the toner was set to approximately 45° C., and the surface temperature of the photosensitive body 1 was set to room temperature (20° C. to 30° C.). The pre-transfer dryer 5 blew air to the toner image and the photosensitive body 1 to dry the toner image to a certain degree.

In this state, the silicone intermediate transfer medium 6 with a hardness of about 50° was pressed against the surface of the photosensitive drum 1 and was rotated. Good primary transfer was possible. The contact pressure between the photosensitive body 1 and intermediate transfer medium 6 is preferably applied with a linear pressure of approximately 0.1 kg/cm to 20 kg/cm in the longitudinal direction of the photosensitive drum 1.

The toner image transferred onto the intermediate transfer medium 6 is secondarily transferred to the surface of a sheet P or the like serving as a transfer target by a backup roller 7 constituting a transfer unit. The backup roller 7 and intermediate transfer medium 6 have heaters 8, so they are heated to the glass transition temperature or more (45° C. in this case) of the toner. The heated toner image on the intermediate transfer medium 6 reaches a secondary transfer region, where the sheet P is sandwiched by the intermediate transfer medium 6 and backup roller 7. A load corresponding to a linear pressure of 0.2 kg/cm to 20 kg/cm in the longitudinal direction is applied to the sheet P, thereby transferring the image to the sheet P.

Figure 2:
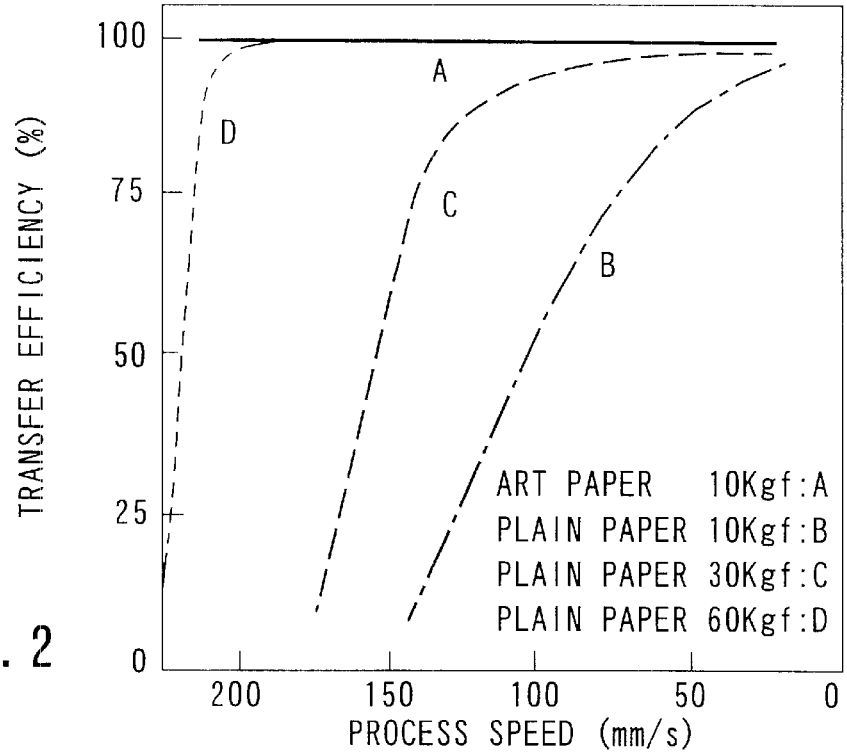
FIG. 2 is a graph showing the transfer characteristics of art paper and plain paper in comparison.

FIG. 2 is a graph showing the transfer characteristics of art paper and plain paper in comparison.

In FIG. 2, the axis of abscissa represents the process speed, and the axis of ordinate represents the transfer efficiency. According to FIG. 2, for art paper, when the secondary transfer load is about 10 kgf (the load on the total length of 270 mm in the longitudinal direction of A4-size paper) and the process speed is 200 mm/s, the transfer efficiency becomes substantially 100%.

For plain paper, when transfer is performed with the same conditions as those described above, the transfer efficiency becomes substantially 0%. Even for plain paper, when the load is increased to 60 kgf, transfer can be performed substantially 100%. Even if the load is not increased, a transfer efficiency of almost 100% can be obtained by extremely decreasing the process speed to 20 mm/s.

Figure 3:
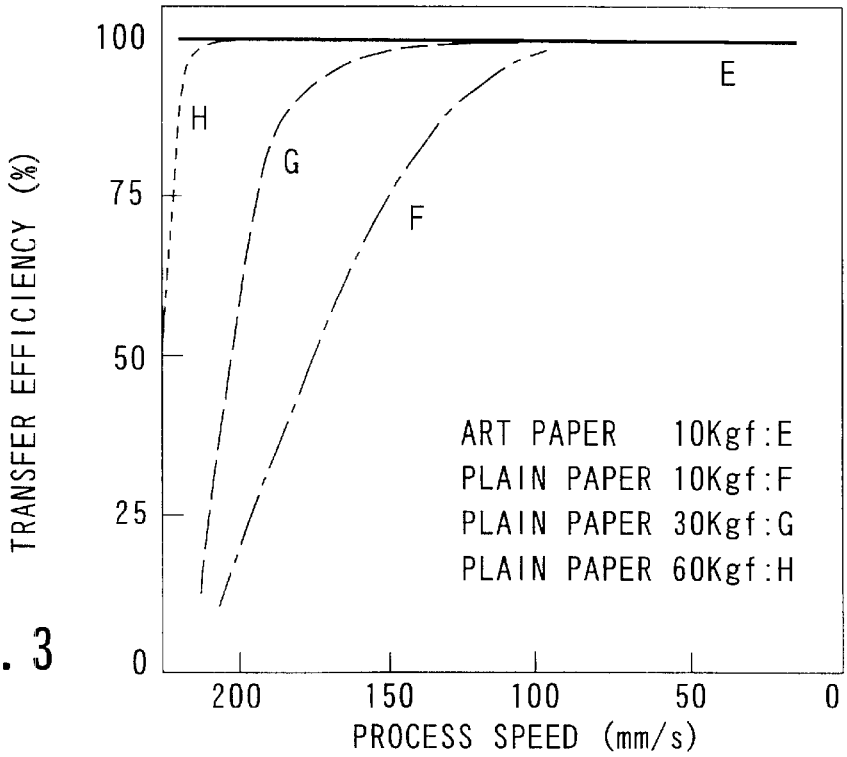
FIG. 3 is a graph showing the transfer characteristics obtained when a toner image is transferred from a photosensitive body to an intermediate transfer medium with an electric field.

These characteristics largely change depending on primary transfer methods. For example, in an apparatus that performs primary transfer with an electric field, the mold release properties of the surface of the intermediate transfer medium 6 can be increased to be higher than that obtained with an apparatus that performs primary transfer by the offset method. A result as shown in FIG. 3 is accordingly obtained. More specifically, secondary transfer can be performed more advantageously, and a load necessary for plain paper can be slightly decreased. Nevertheless, a necessary load still differs between plain paper and art paper, and an effect can be obtained by employing the present invention, as a matter of course.

As the adjustment range of the pressure, if the average pressure applied within the transfer nip is 1 kg/cm$^2$ or more, good transfer can be performed in most cases. Plain paper, however, requires a pressure of 10 kg/cm$^2$ or more, and a higher pressure is sometimes necessary depending on the types of intermediate transfer media 6 or the sheets on which transfer is to be performed. Particularly, when the transfer speed is increased, a high pressure becomes necessary. For example, the transfer speed is higher than 400 mm/s, a pressure of about 50 kg/cm$^2$ is sometimes necessary.

Figure 4:
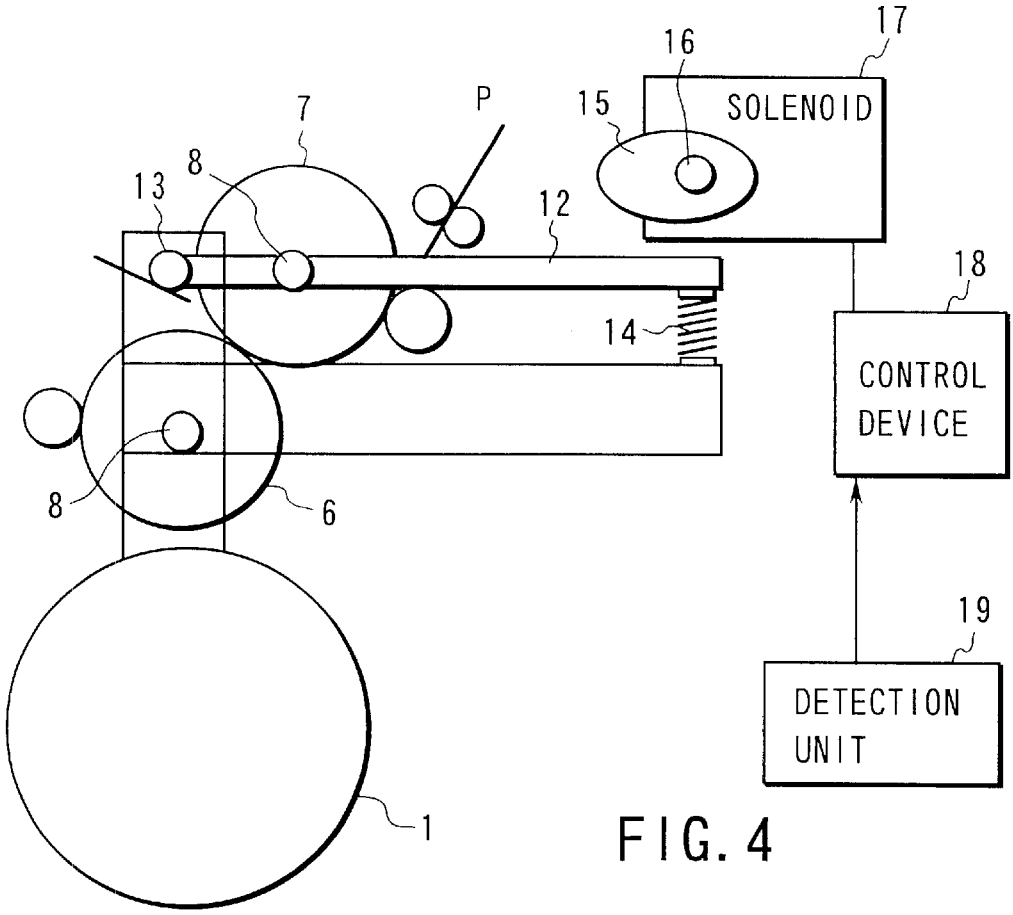
FIG. 4 is a view showing the arrangement of a changing device which variably controls the pressing force of the sheet against the intermediate transfer medium.

FIG. 4 shows a changing device 11 for variably controlling the pressing force of the sheet against the intermediate transfer medium 6.

The changing device 11 has an arm 12 with one end side attached with the backup roller 7. One end of the arm 12 is pivotally supported by a support shaft 13. The other end of the arm 12 is biased upward by a spring member 14.

A cam member 15 is provided above the other end of the arm 12 and is connected to a solenoid 17 through a driving shaft 16. The solenoid 17 is connected to a control device 18 through a control circuit. The control device 18 is connected to a detection unit 19 serving as a determining means through a signal line. The detection unit 19 detects the type of sheet and transmits detection information to the control device 18. The control device 18 operates the solenoid 17 in accordance with the detection information transmitted from the detection unit 19.

The operation of the changing device 11 will be described.

When no paper is to be passed, as shown in FIG. 4, the cam 15 is pivoted by the solenoid 17 to the horizontal state to be separated from the arm 12. Thus, the arm 12 is biased upward by the spring 14 and pivots upward about the support fulcrum 13 as the center. This pivot operation moves the backup roller 7 upward to separate it from the intermediate transfer medium 6.

Figure 5:
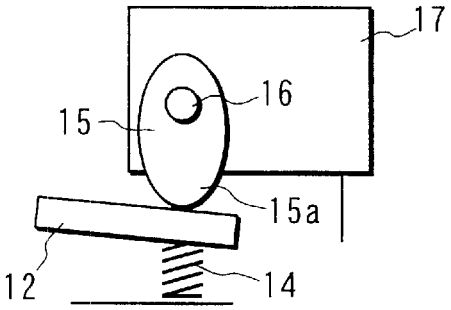
FIG. 5 is a view showing the operation of the changing device when plain paper is to be passed.

When plain paper is to be passed, detection information indicating that plain paper is detected is transmitted from the detection unit 19 to the control device 18 to operate the solenoid 17. Thus, as shown in FIG. 5, the cam 15 is pivoted downward, and its long portion 15*a* pivots the arm 12 downward against the biasing force of the spring 14. The arm 12 deflects as it pivots downward, whereby the backup roller 7 strongly press the plain paper to the intermediate transfer medium 6.

Figure 6:
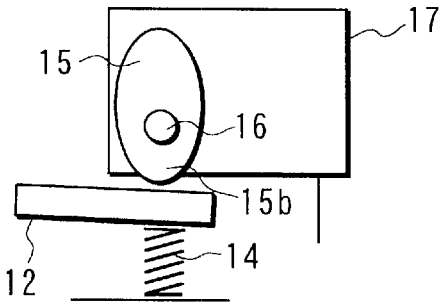
FIG. 6 is a view showing the operation of the changing device when art paper is to be passed.

When art paper is to be passed, detection information indicating that art paper is detected is transmitted from the detection unit 19 to the control device 18 to operate the solenoid 17. Thus, as shown in FIG. 6, the cam 15 is pivoted downward. When the cam 15 pivots, it pivots the arm 12 downward with its short portion 15*b* against the biasing force of the spring 14. When the arm 12 pivots downward, the backup roller 7 weakly urges art paper against the intermediate transfer medium 6.

Figure 7:
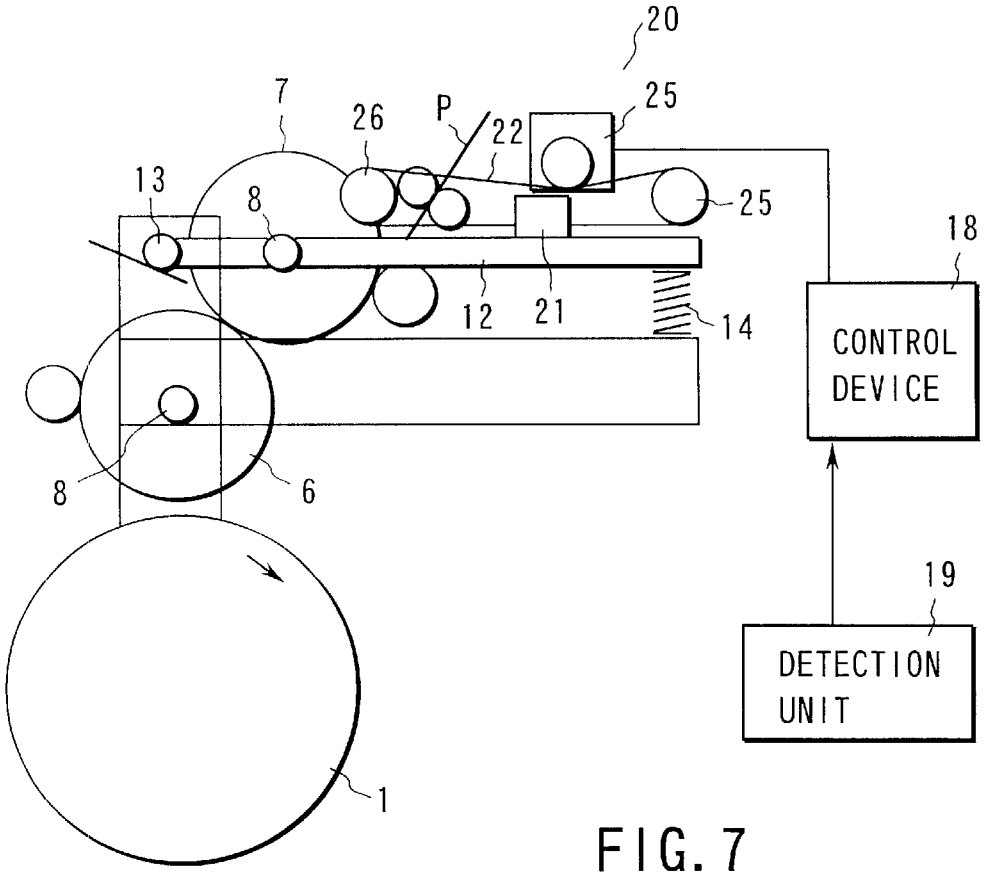
FIG. 7 is a view showing the arrangement of the changing device according to the second embodiment.

FIG. 7 is a view showing a changing device which is the second embodiment of the invention.

In the changing device 20, i.e., the second embodiment, a weight 21 is slidably provided along the upper surface of the arm 12, and is connected to a driving belt 22. The driving belt 22 extends between rollers 23 and 24 and is moved by a driving motor 25 to travel in the forward and backward directions. The driving motor 25 is connected to the control device 18 similar to that described above, and the control device 18 is connected to the detection unit 19.

When art paper is to be passed, detection information indicating that art paper is detected is transmitted from the detection unit 19 to the control device 18 to rotate the driving motor 25. When the driving motor 25 is rotated, the weight 21 is moved to be located at substantially the intermediate portion between the rollers 25 and 26. When the weight 21 is moved, the backup roller 7 is abutted against the intermediate transfer medium 6 with a weak force to urge the art paper P against the intermediate transfer medium 6 with a weak force.

Figure 8:
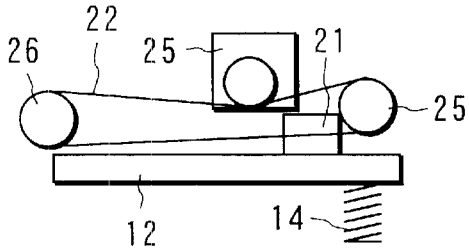
FIG. 8 is a view showing the operation when plain paper is to be passed.

When plain paper is to be passed, detection information indicating that plain paper is detected is transmitted from the detection unit 19 to the control device 18 to rotate the driving motor 25. When the driving motor 25 is rotated, the weight 21 is moved to a position close to the roller 25, as shown in FIG. 8. When the weight 21 is moved, an arm 12 is largely pivoted downward against the biasing force of the spring 14. The backup roller 7 is abutted against the intermediate transfer medium 6 with a strong force to urge the plain paper against the intermediate transfer medium 6 with a strong force.

Figure 9:
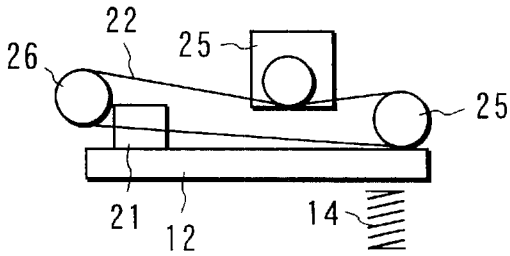
FIG. 9 is a view showing the operation in the paper non-passing mode.

When no paper is to be passed, information indicating that no paper is detected is transmitted from the detection unit 19 to the control device 18 to rotate the driving motor 25. When the driving motor 25 is rotated, as shown in FIG. 9, the weight 21 is moved to a position close to the roller 26. When the weight 21 is moved, the arm 12 is pivoted upward by the biasing force of the spring 14, and the backup roller 7 is separated from the intermediate transfer medium 6.

Figure 10:
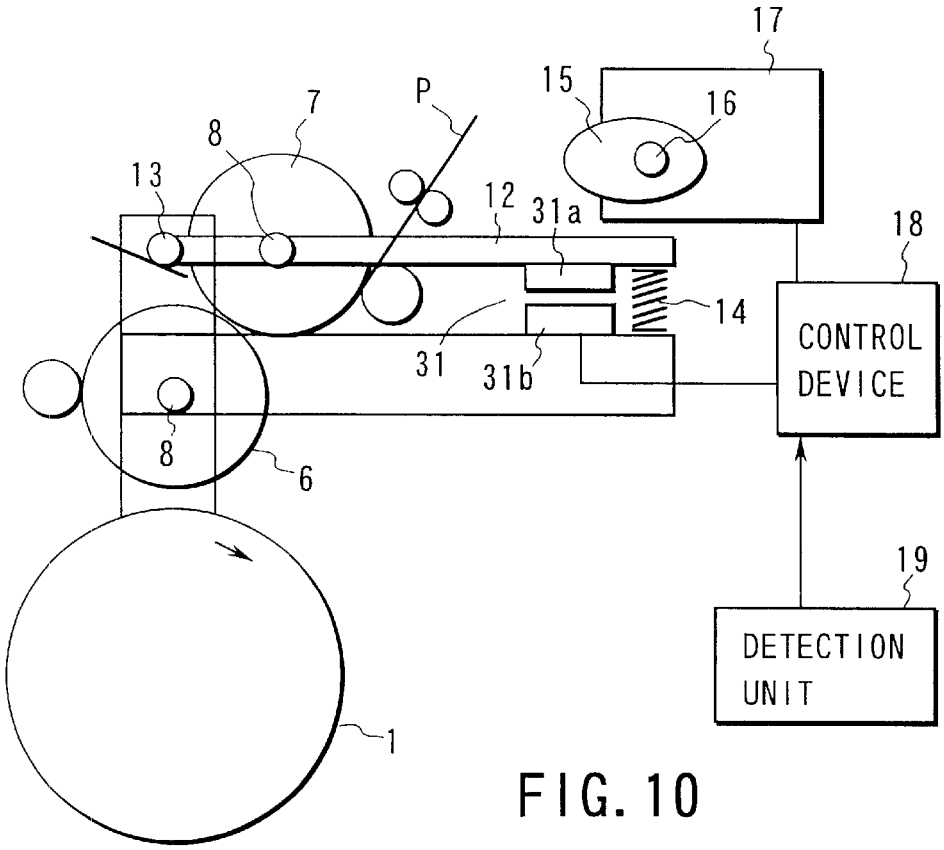
FIG. 10 is a view showing the arrangement of the changing device according to the third embodiment.

FIG. 10 is a view showing the arrangement of the changing device according to the second modification.

A changing device 30 according to the second modification is obtained by adding an electromagnet 31 to the structure shown in FIG. 4.

More specifically, the electromagnet 31 has upper and lower magnet pieces 31*a* and 31*b*. The upper magnet piece 31*a* is attached to the other end of the arm 12. The lower magnet piece 31*b* is stationarily provided to be separate from the upper magnet piece 31*a* to face it. The lower magnet piece 32 is connected to the control device 18, and the control device 18 is connected to the detection unit 19.

According to the third modification, the operations of passing no paper and passing art paper are similar to those shown in FIGS. 4 and 6. When plain paper is to be passed, in addition to the operation shown in FIG. 5, the control device 18 energizes the electromagnet 31. The electromagnet 31 is thus excited, and the upper magnet piece 31 is attracted by the lower magnet piece 32. Hence, the arm 12 is firmly held so that it can reliably urge the plain paper against the intermediate transfer medium 6 with a strong force.

Figure 11:
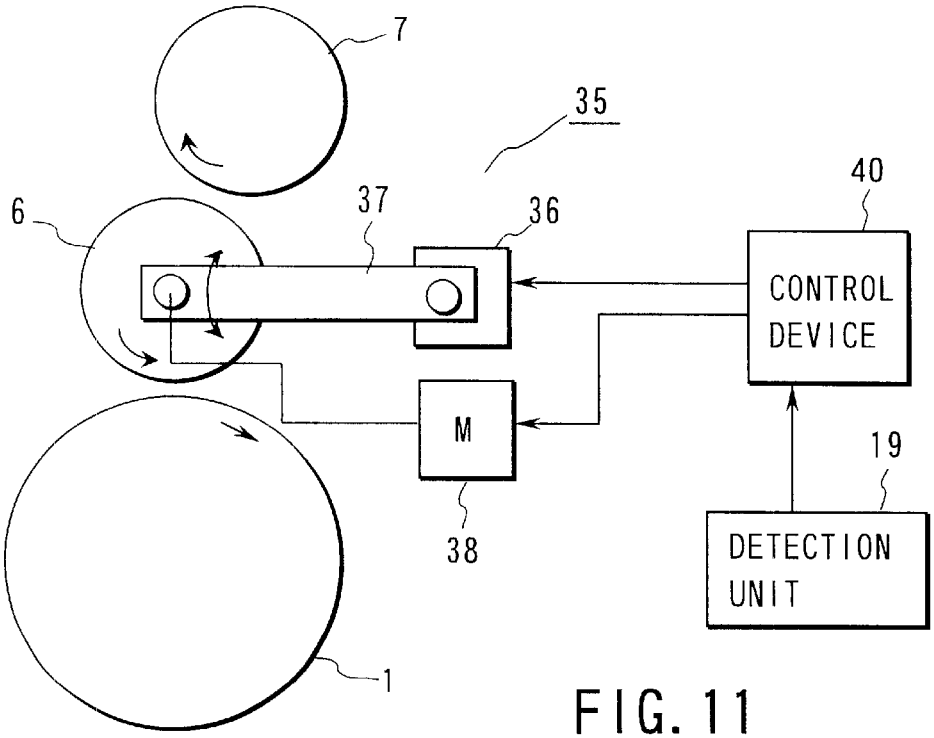
FIG. 11 is a view showing the arrangement of an image forming unit according to the second embodiment of the present invention.

FIG. 11 shows an image forming unit according to the second embodiment of the present invention.

The same portions as those shown in the first embodiment described above are denoted by the same reference numerals as in the first embodiment, and a detailed description thereof will be omitted.

According to the second embodiment, an intermediate transfer medium 6 is driven by a driving mechanism 35 to come into contact with and separate from a photosensitive body 1. The driving mechanism 35 is constituted by a driving unit 36 and a swing lever 37 which is swung by the driving unit 36. The intermediate transfer medium 6 is attached to the swing end of the swing lever 37. The intermediate transfer medium 6 is rotated by a variable-speed driving motor 38. The driving unit 36 and driving motor 38 are connected to a control device 40 through control circuits, and the control device 40 is connected to a detection unit 19 which detects the type of sheet through a signal line 41.

Figure 12:
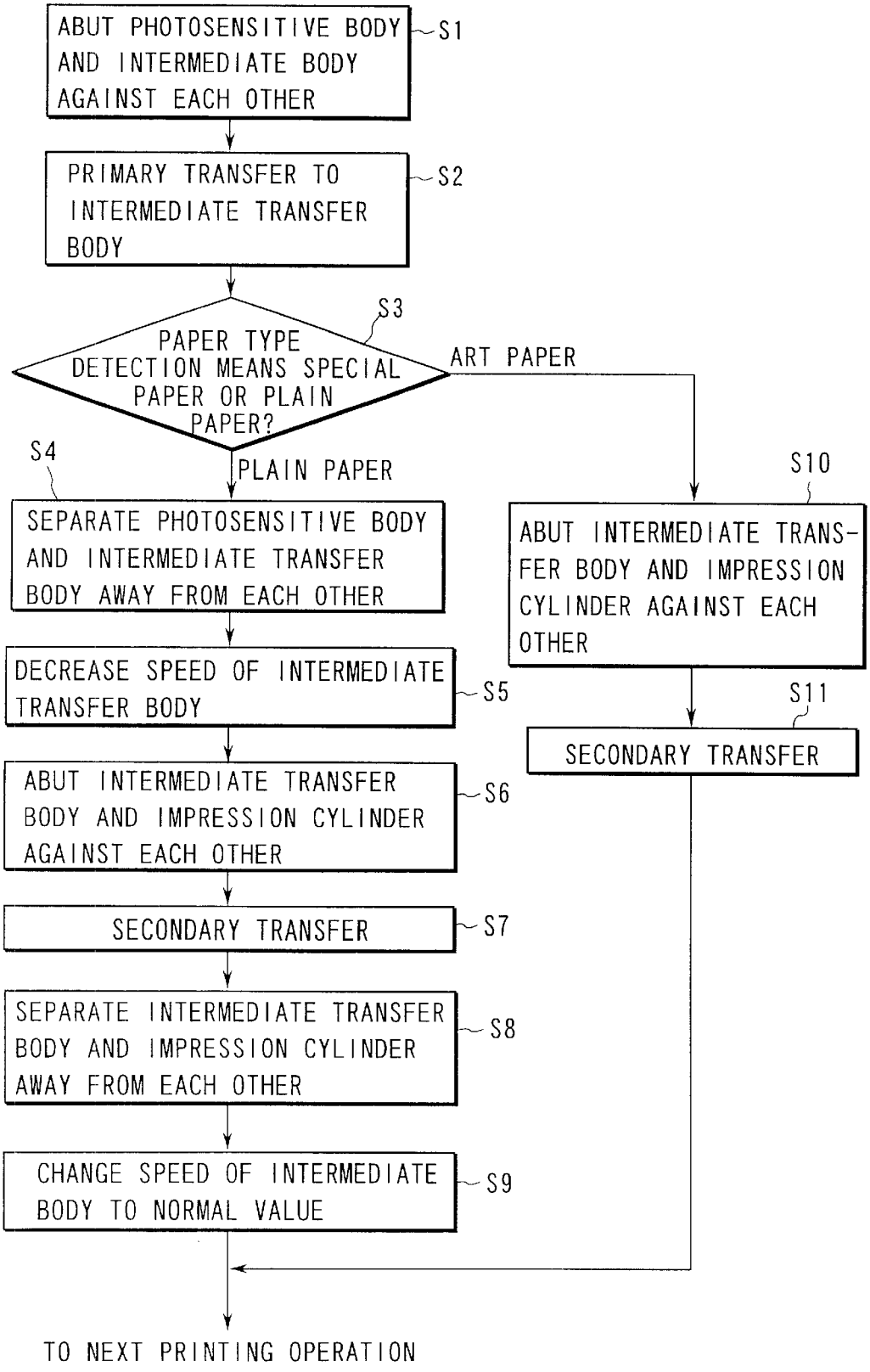
FIG. 12 is a flow chart showing the operation of the image forming unit shown in FIG. 11.

FIG. 12 is a flow chart showing the operation of the image forming unit.

When an image is to be formed, the driving unit 36 is operated to pivot the swing arm 37 downward, so that the intermediate transfer medium 6 abuts against the photosensitive body 1 (step S1). After this abutment, the toner image on the photosensitive body 1 is primarily transferred to the intermediate transfer medium 6 (step S2). The detection unit 19 detects a sheet to be passed and determines whether it is plain paper or art paper (step S3). If the sheet is plain paper, the driving unit 36 pivots the swing arm 37 upward to separate the intermediate transfer medium 6 from the photosensitive body 1 (step S4). Then, the driving motor 38 rotates the intermediate transfer medium 6 at a low speed (step S5). A backup roller 7 is abutted against the intermediate transfer medium 6 (step S6). Thus, the toner image on the intermediate transfer medium 6 is secondarily transferred to the backup roller 7 (step S7). After this transfer, the backup roller 7 is separated from the intermediate transfer medium 6 (step S8). Subsequently, the rotational speed of the intermediate transfer medium 6 is changed to a normal value (step S9), and the next printing operation is performed.

In step S3, if the type of sheet is art paper, the backup roller 7 is abutted against the intermediate transfer medium 6 (step S10). Hence, the toner image on the intermediate transfer medium 6 is secondarily transferred to the art paper (step S11). After this transfer, the next printing operation is performed.

Figure 13:
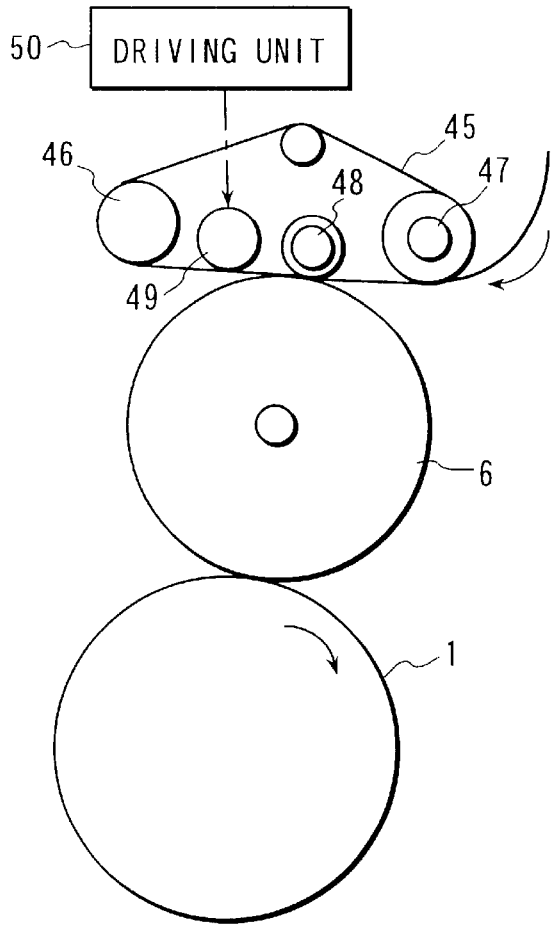
FIG. 13 is a view showing the arrangement of an image forming unit according to the third embodiment of the present invention.

FIG. 13 is a view showing the arrangement of an image forming unit according to the third embodiment of the present invention.

Portions identical to those described in the first embodiment described above are denoted by the same reference numerals as in the first embodiment, and a detailed description thereof will be omitted.

According to the third embodiment, a transfer belt 45 is provided above an intermediate transfer medium 6 to extend through a plurality of rollers 46 and 47. A backup roller 48 is pressed against the intermediate transfer medium 6 through the transfer belt 45. An auxiliary roller 49 is provided near the backup roller 48. The auxiliary roller 49 is vertically moved by a driving device 50 to move the intermediate transfer medium 6 to come close to and separate from the intermediate transfer medium 6.

Figure 14:
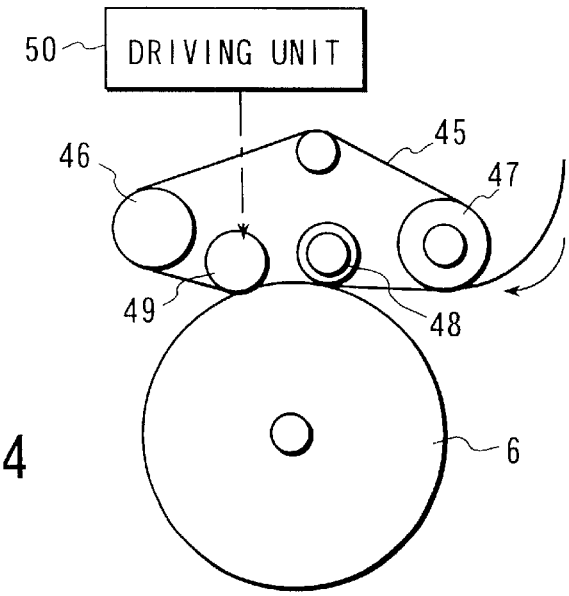
FIG. 14 is a view showing image transfer operation when plain paper is to be passed.

According to the third embodiment, the transfer time is prolonged by increasing the transfer nip width for secondary transfer. More specifically, the third embodiment exemplifies a method of conveying the sheet by attracting it with the transfer belt 45. For plain paper, as shown in FIG. 14, the auxiliary roller 49 is pressed against the intermediate transfer medium 6 to widen the transfer nip, thereby prolonging the transfer time. The transfer nip width is usually about 1 mm to 10 mm, but can be increased to about 20 mm to 100 mm by further pressing the auxiliary roller 49 against the intermediate transfer medium 6.

When the transfer time is prolonged, a toner image can be transferred to even paper with a rough surface. However, since the pressure dependency is high, a sufficient effect cannot be obtained unless the transfer time is prolonged very long. When the transfer nip is excessively widened, image disturbance tends to be caused by fine fluctuations in speed. Hence, for art paper or the like which requires only a short transfer time, the nip width should be minimized.

According to this embodiment, the transfer nip is largely widened by the auxiliary roller 49 only for plain paper with which the transfer efficiency is the first priority.

TABLE 1

Result of Service Life Test (Number of Sheets Passed Until Intermediate Transfer Body is Damaged by Paper Jamming or the Like to Adversely Affect Image and Until Transfer Efficiency Decreases to 70% or Less)

| | Paper Passing Ratio | First Time | Second Time | Third Time |
|---|---|---|---|---|
| Present invention not | art paper | 10k sheets | 9.5k sheets | 15k sheets |
| applied (Load: 60 kgf) | art paper 1:1 plain paper | 12k sheets | 13k sheets | 8k sheets |
| Load of 10 kgf applied | art paper | 60k sheets | 40k sheets | 50k sheets |
| for art paper | plain paper | 11k sheets | 9k sheets | 9k sheets |
| Load of 60 kgf applied | art paper 1:1 plain paper | 20k sheets | 15k sheets | 25k sheets |
| for plain paper | art paper 4:1 plain paper | 50k sheets | 50k sheets | 35k sheets |
| Transfer speed | art paper 1:1 plain paper | 25k sheets | 30k sheets | 30k sheets |
| decreased to ⅕ plain paper | art paper 4:1 plain paper | 40k sheets | 50k sheets | 40k sheets |

Table 1 shows the comparison results of the service life of the intermediate transfer medium 6 among cases wherein the present invention described above is and is not employed.

When printing was performed with only plain paper from the beginning to the end, no effect was obtained at all with the present invention. An obvious difference was observed in the service life of the intermediate transfer medium 6 between a case wherein plain paper and art paper in the same amount are passed and a case wherein art paper and plain paper were passed at a ratio of 4:1.

More specifically, the service life of the intermediate transfer medium 6 is prolonged when a pressure more than necessary is not applied. The type of the paper used may be detected by various methods. The most simple method is manual input of the data representing the type of the paper. The surface roughness of the paper need not be measure. It is sufficient for the user to input data showing whether the paper is of a special type or the ordinary type.

When toner with very fine particles such as liquid toner is to be transferred to a sheet with a rough surface such as plain paper, the lower the image density of the toner layer, i.e., the smaller the thickness of the toner layer, the lower the transfer efficiency. This is because a thick toner layer is formed as a film and is transferred, whereas a thin toner layer with a thickness of less than 0.4 $\mu$m cannot be formed as a film well. Hence, a thinner toner layer which is more difficult to be formed as a film leads to a lower transfer efficiency.

Figure 15:
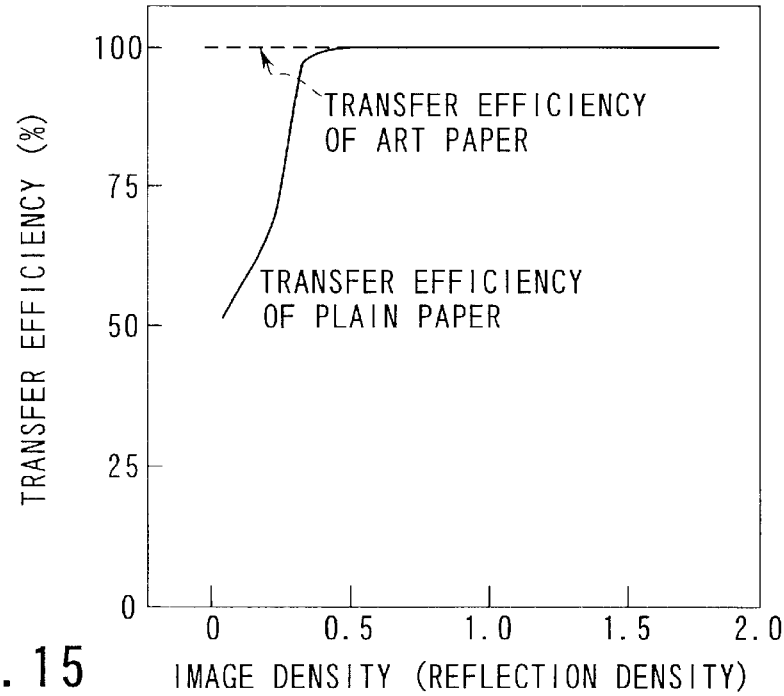
FIG. 15 is a graph showing the transfer efficiency of art paper add plain paper in comparison.

FIG. 15 is a graph showing the relationship between the image density and transfer efficiency.

When the image density becomes 0.5 or less, the transfer efficiency obviously decreases in plain paper. At this time, the thickness of the toner layer was approximately 0.2 $\mu$m to 0.4 $\mu$m when observed with an SEM.

According to the present invention, a table of the transfer efficiency with respect to the image density is stored in a CPU or the like in advance. When paper with a rough surface is to be passed, the image density is increased to be higher than that in a case wherein paper such as art paper with a smooth surface is to be passed. Particularly, exposure is controlled to be corrected so a low-density portion will not be formed in the toner image.

Figure 16:
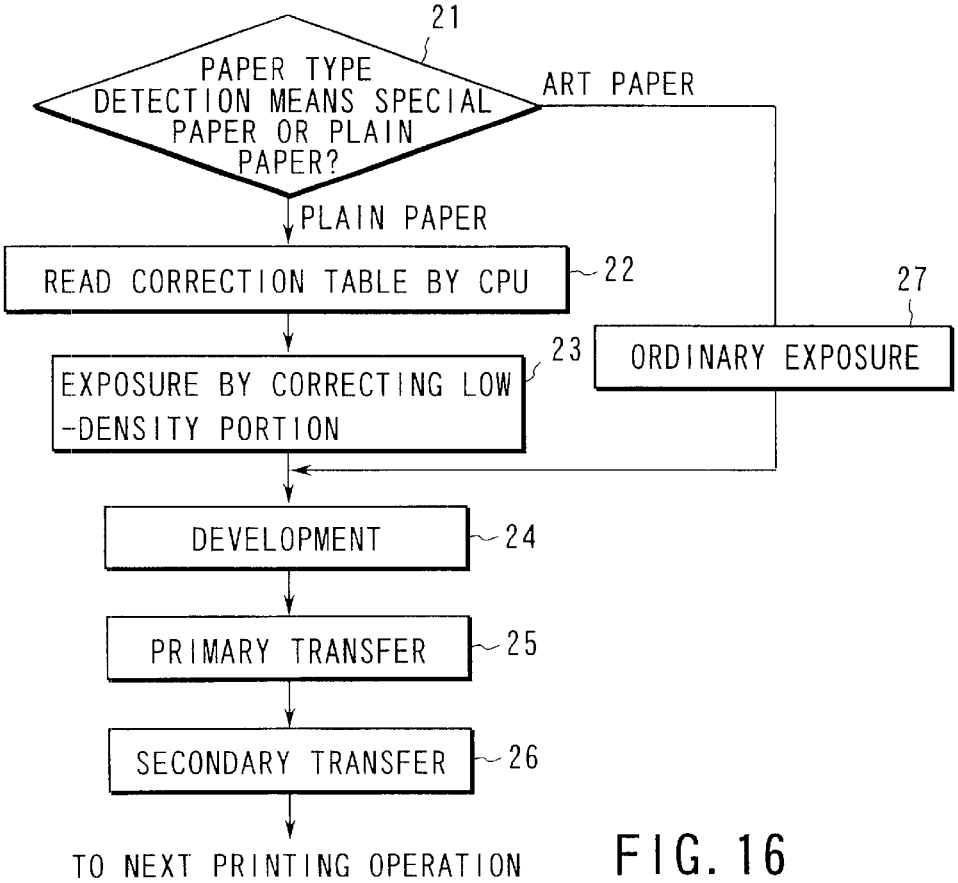
FIG. 16 is a flow chart showing image forming operation for art paper and plain paper.

FIG. 16 is a flow chart showing practical operation.

In passing a sheet, the detection unit 19 detects the type of sheet and determines whether the sheet is plain paper or special paper (step S21). If the sheet is plain paper, the control device 18 reads a correction table (step S22). The photosensitive body 1 is corrected and exposed to form a latent image. More specifically, the photosensitive body 1 is exposed after it is corrected such that, when the latent image is developed to form a toner image, a low-density portion will not be formed in the toner image (step S23). After the latent image is formed in this manner, the developing solution is supplied to develop it (step S24). This toner image is primarily transferred from the photosensitive drum 1 to the intermediate transfer medium 6 (step S25). Subsequently, the toner image is secondarily transferred from the intermediate transfer medium 6 to the sheet P (step S26).

In step S1, if the sheet is art paper, ordinary exposure is performed (step S27), and operations from step S24 are performed.

As described above, according to the present invention, in the electrophotographing apparatus for transferring a liquid toner image to a sheet through the intermediate transfer medium 6, the pressure or transfer time during secondary transfer is controlled in accordance with the type of sheet to be used. Therefore, the service life of expendables such as the intermediate transfer medium 6 can be prolonged, and good transfer is enabled.

If the sheet has a rough surface, the transfer efficiency at the low-density image portion decreases. However, the electrostatic latent image is formed after correcting exposure in advance so as not to form a low-density image portion in the toner image, and is developed. Therefore, an image with a high image quality can be obtained in the same manner as in a case wherein the sheet has a smooth surface.

The embodiments described above show that according to the present invention, the pressure of secondary transfer, i.e., the abutting force between the intermediate transfer medium 6 and backup roller 7, is changed in accordance with the type of sheet, so that both the service life of the intermediate transfer medium 6 and the good transfer performance of the plain paper are satisfactory.

When the load during secondary transfer is increased, the amount of deformation of the intermediate transfer medium 6 increases, and the image is undesirably elongated on the sheet, thus posing another problem.

In order to prevent this, according to the present invention, when the load in secondary transfer is to be increased in printing on plain paper and the like, the load in primary transfer from the photosensitive drum 1 to the intermediate transfer medium 6 is also increased. As a result, the elongation and shrinkage in image in primary and secondary transfer operations cancel each other, so that elongation and shrinkage in the final image are eliminated.

More specifically, in secondary transfer of the toner image from the intermediate transfer medium 6 to the sheet, the larger the load, the longer the image becomes. In primary transfer of the toner from the photosensitive body 1 to the intermediate transfer medium 6, the larger the load, the shorter the transferred image becomes.

Accordingly, when the load in secondary transfer is to be increased for printing on plain paper or the like, if the load in primary transfer is also increased simultaneously, elongation and shrinkage in the final image can be eliminated.

Figure 17:
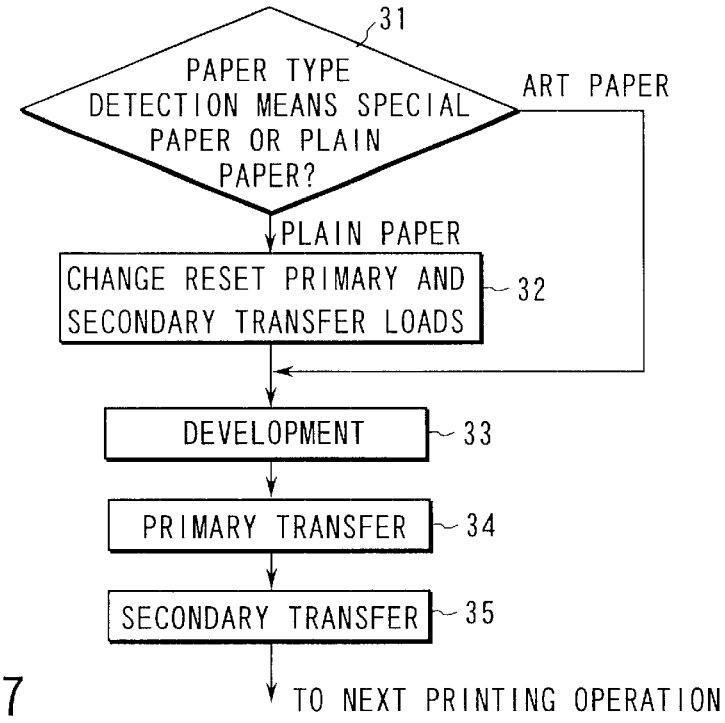
FIG. 17 is a flow chart showing first another image forming operation according to the present invention.

FIG. 17 is a flow chart showing practical operation.

When a sheet is being passed, the detection unit 19 detects it and determines whether it is plain paper or art paper (step S31). When the sheet is plain paper, the abutting force between the intermediate transfer medium 6 and backup roller 7 is increased, and the abutting force between the intermediate transfer medium 6 and photosensitive body 1 is also increased. More specifically, the loads in primary and secondary transfer operations are appropriately changed (step S32). After that, the latent image on the photosensitive drum 1 is developed to form a toner image (step S33), and the toner image is primarily transferred from the photosensitive drum 1 onto the intermediate transfer medium 6 (step S34). After that, the toner image transferred onto the intermediate transfer medium 6 is secondarily transferred to the sheet P (step S35). In step S31, if the sheet is art paper, operations from step S33 are performed.

In this manner, the image on the intermediate transfer medium 6 can be shortened without changing the length of the toner image on the photosensitive drum 1. The image is elongated by the large load in secondary transfer, and finally transferred to the sheet P as an image with a right length.

According to the present invention, when the transfer load is set large for performing printing on plain paper, the length of the image may be adjusted by setting the rotational speed of the photosensitive drum 1 to slightly low.

More specifically, when the rotational speed of the photosensitive drum 1 is set to slightly low, the toner image is formed on the photosensitive drum 1 to be slightly short. This toner image is primarily transferred to the intermediate transfer medium 6. When a large load is applied in secondary transfer, the slightly short toner image is elongated, and finally transferred on the sheet as an image with a right length.

In this case, the rotational speed of the intermediate transfer medium 6 must also be decreased in accordance with the rotational speed of the photosensitive drum 1. The sheet convey speed must also be decreased in accordance with the rotational speed of the intermediate transfer medium 6.

The length of the image can be adjusted by adjusting the convey speeds of the photosensitive drum 1, intermediate transfer medium 6, and sheet P to have different speeds. When the photosensitive drum 1, intermediate transfer medium 6, and backup roller 7 are abutted against each other with large pressures, as in the present invention, it is difficult to drive them while maintaining fine speed differences among them. According to the present invention, in primary transfer, transfer can be performed with a comparatively small load. Hence, if a speed difference is to be provided, it is preferably done so in primary transfer, or second transfer if the sheet is art paper.

Figure 18:
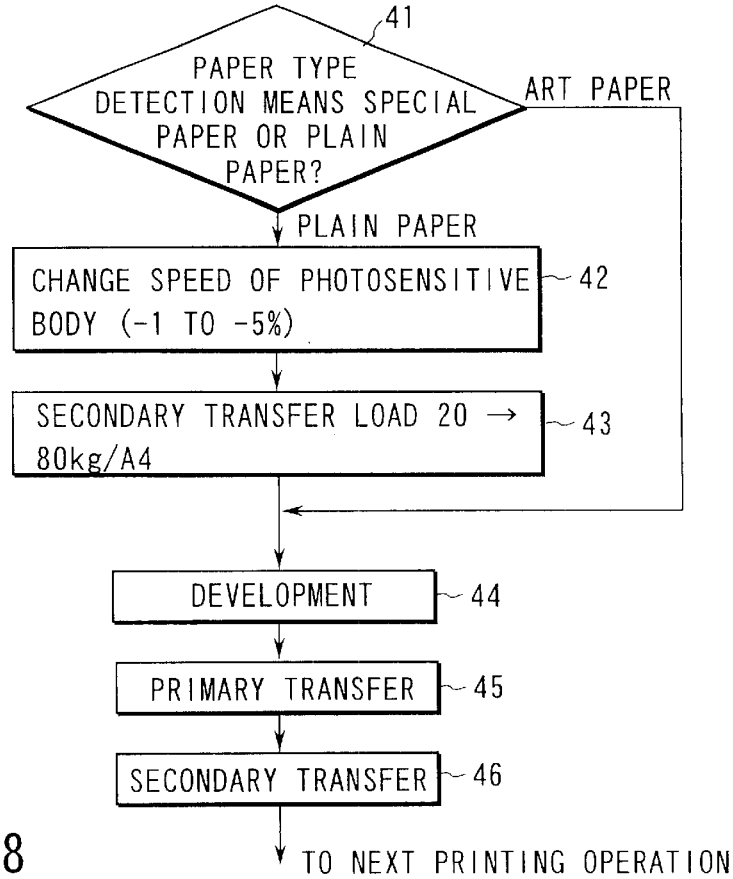
FIG. 18 is a flow chart showing second another image forming operation according to the present invention.

FIG. 18 is a flow chart showing practical operation.

In passing a sheet, the detection unit 19 detects it and determines whether it is plain paper or art paper (step S41). If the sheet is plain paper, the rotational speed of the photosensitive body 1 is decreased by 1% to 5% (step S42). After that, the secondary transfer load is increased from 20 kg/A4 to 80 kg/A4 (step S43). Subsequently, the latent image on the photosensitive drum 1 is developed with the liquid developer (step S44). After development, the developer image on the photosensitive drum 1 is primarily transferred to the intermediate transfer medium 6 (step S45). Subsequently, the developer image is secondarily transferred to the sheet by rotation of the intermediate transfer medium 6 (step S46).

In step 41, if the sheet is art paper, operations from step 44 described above are performed.

According to the present invention, when a large secondary transfer load is set, the rotational speed of the intermediate transfer medium 6 may be decreased to be lower than that in an ordinary case.

More specifically, when a large secondary transfer load is set to cope with plain paper, the intermediate transfer medium 1 is rotated at a speed lower than that of the photosensitive drum 1 by 1% to 5%.

Hence, an image is transferred short onto the intermediate transfer medium 6. This shrinkage in image is canceled when the transferred short image is elongated as a load is applied to it in secondary transfer. The shrinkage-canceled image is transferred to the sheet.

In this case, separate driving units are required for the photosensitive body 1 and intermediate transfer medium 6. The backup roller 7 may be rotatably driven at substantially the same speed as that of the intermediate transfer medium 6, or may be driven by the intermediate transfer medium 6.

Figure 19:
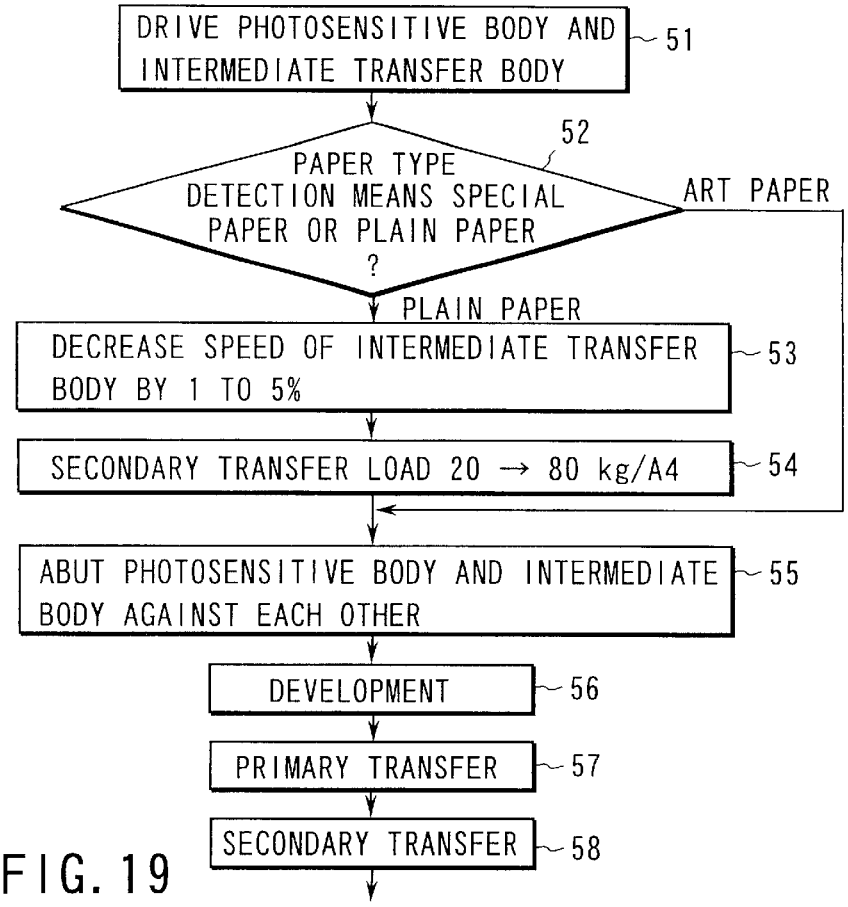
FIG. 19 is a flow chart showing third another image forming operation according to the present invention.

FIG. 19 is a flow chart showing practical operation.

The photosensitive drum 1 and intermediate transfer medium 6 are rotatably driven (step S51). In passing a sheet, the detection unit 19 detects it and determines whether it is plain paper or art paper (step S52). If the sheet is plain paper, the rotational speed of the photosensitive drum 1 is decreased by 1% to 5% (step S53). Subsequently, the secondary transfer load is increased from 20 kg/A4 to 80 kg/A4 (step 554). After that, the intermediate transfer medium 6 is abutted against the photosensitive body 1 (step S55). After this abutment, the latent image on the photosensitive body 1 is developed with a liquid developer (step S56). After development, the developer image on the photosensitive body 1 is primarily transferred on the intermediate transfer medium 6 (step S57). Subsequently, the developer image is secondarily transferred to the sheet by rotation of the intermediate transfer medium 6 (step S58).

In step 52, if the sheet is art paper, operations from step 55 described above are performed.

According to the present invention, as shown in FIG. 18, when a large load in secondary transfer is set and a low rotational speed is set for the photosensitive drum 1 so as not to elongate the final image, if a low secondary transfer load is set in the art paper mode or the like, the sheet may be driven faster than the intermediate transfer medium 6.

Therefore, even if a low load is set in secondary transfer, a final image free from elongation or shrinkage can be consequently obtained.

In this case, note that all the photosensitive body 1, intermediate transfer medium 6, and backup roller 7 must be driven.

Figure 20:
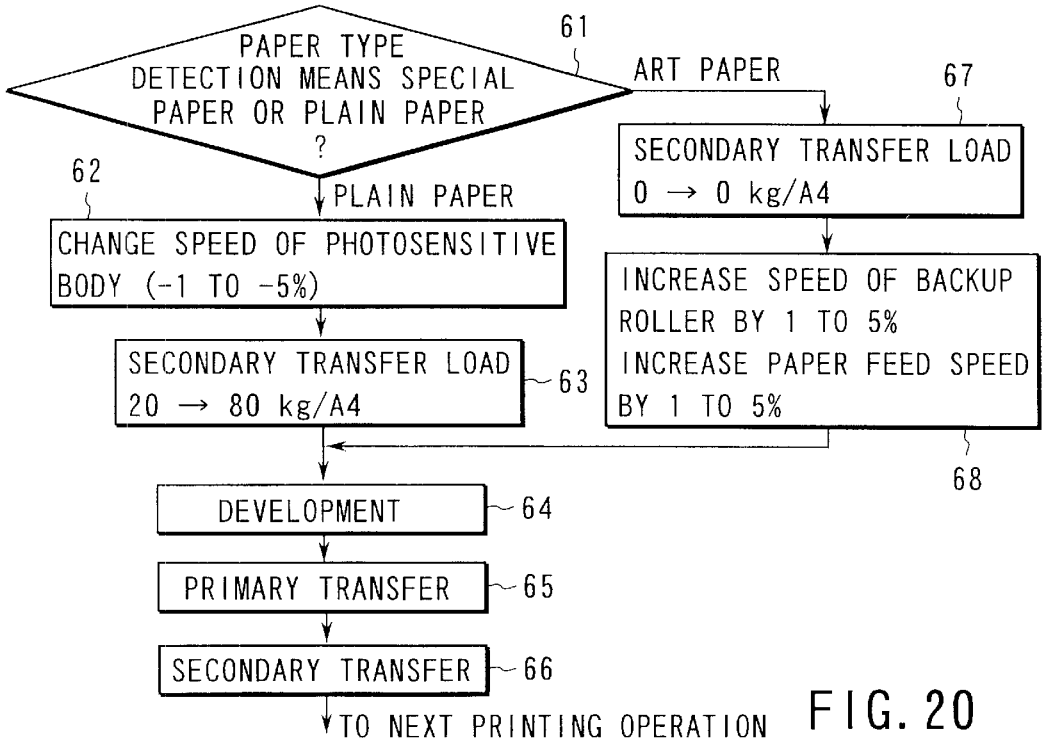
FIG. 20 is a flow chart showing fourth another image forming operation according to the present invention.

FIG. 20 shows a flow chart showing practical operation.

In passing a sheet, the detection unit 19 detects it and determines whether it is plain paper or art paper (step S61). If the sheet is plain paper, the rotational speed of the photosensitive body 1 is decreased by 1% to 5% (step S62). After that, the secondary transfer load is increased from 20 kg/A4 to 80 kg/A4 (step S63). Subsequently, the latent image on the photosensitive drum 1 is developed with the liquid developer (step S64). After development, the developer image on the photosensitive body 1 is primarily transferred to the intermediate transfer medium 6 (step S65). Subsequently, the developer image is secondarily transferred to the sheet by rotation of the intermediate transfer medium 6 (step S66).

When the rotational speed of the photosensitive drum 1 is decreased by 1% to 5% and the secondary transfer load is increased from 20 kg/A4 to 80 kg/A4, if it is determined in step S61 that the sheet being passed is art paper, the secondary transfer load is decreased from 80 kg/A4 to 20 kg/A4 (step S67), and the rotational speed of the backup roller 7 is increased by 1% to 5%, so that the paper feed speed is increased by 1% to 5% (step S68). After that, operations from step S63 described above are performed.

Experimental results will be described.

In experiments, the secondary transfer load was set to 10 kg/A4 to 20 kg/A4 for art paper and 80 kg/A4 to 100 kg/A4 for plain paper. When the present invention was not employed, the length of the image on the plain paper undesirably increased by 3% or more.

In the experiment concerning FIG. 17, the primary transfer load, which is usually set to about 20 kg/A4, was increased to about 100 kg/A4 only when plain paper was to be passed. An elongation of about 3% finally became substantially 0.

A change unit which changes the pressure contact force between the photosensitive drum 1 and intermediate transfer medium 6 in primary transfer can operate on the same principle as that for the changing device 11 which changes the abutting force between the intermediate transfer medium 6 and backup roller 7 in secondary transfer shown in the first embodiment described above. Therefore, this change unit will not be described particularly in detail.

In the experiment concerning FIG. 18, when the rotational speed of the photosensitive drum 1 was decreased by about 3% only when printing plain paper, a good image free from elongation or shrinkage was obtained on the sheet. In this experiment, since the intermediate transfer medium 6 is driven by the photosensitive drum 1, a large speed difference does not occur between them, and the surface of the intermediate transfer medium 6 will not be damaged.

Since the speed of the photosensitive drum 1 was changed only by about 1% to 5%, it did not adversely affect other processes substantially at all, and no undesirable effects were caused by this.

In the experiment concerning FIG. 19, in the plain paper mode, when the rotational speed of the intermediate transfer medium 6 was decreased by 3%, an elongation or shrinkage on the image was eliminated. The primary transfer load was set to 10 kg/A4. This may help maintain the speed difference stably.

In the experiment concerning FIG. 20, the speed of the photosensitive body was changed from the initial value to the value shown in FIG. 18, and the secondary transfer load was decreased to 10 kg/A4 when art paper was to be passed. In this state, the image was shortened by about 3.5%. When the speed of the sheet was increased by 3% to 4%, shrinkage in the image disappeared, and a good image was obtained.

As has been described above, according to the present invention, even when the load applied by the intermediate transfer medium 6 to the sheet in secondary transfer of the toner image is changed, an elongation or shrinkage in the final image can be avoided, and a good image can be obtained.

Additional advantages and modifications will readily occur to those skilled in the art. Therefore, the invention in its broader aspects is not limited to the specific details and representative embodiments shown and described herein. Accordingly various modifications may be made without departing from the spirit or scope of the general inventive concept as defined by the appended claims and their equivalents.

What is claimed is:

1. An image forming apparatus comprising:

an image forming unit for forming an electrostatic latent image on an image carrier;

a developing unit for developing the electrostatic latent image on said image carrier with a developing solution obtained by dispersing developer particles in a solvent, thereby forming a visible image;

an intermediate transfer medium abutted against said image carrier to transfer the visible image on said image carrier thereto;

a transfer unit having a backup member abutted against said intermediate transfer medium, said backup member urging a transfer target against said intermediate transfer medium, thereby transferring the visible image on said intermediate transfer medium to said transfer target;

a determination unit for determining a type of said transfer target to which the visible image is to be transferred by said transfer unit; and a control unit for variably controlling a pressing force applied by said backup member to said transfer target in accordance with the type of said transfer target determined by said determination unit.

2. An image forming apparatus according to claim 1, wherein said control unit variably controls the pressing force of said backup member within a range of 1 kg/cm$^2$ to 50 kg/cm$^2$.

3. An image forming apparatus according to claim 1, wherein the type of said transfer target determined by said determination unit is a surface roughness of the transfer target, and the pressing force of said backup member is increased when the transfer target has a large surface roughness.

4. An image forming apparatus according to claim 1, wherein the visible image is transferred from said image carrier to said intermediate transfer medium with a pressure or a pressure and heat.

5. An image forming apparatus according to claim 1, wherein an abutting force with which said intermediate transfer medium abuts against said image carrier is variably controlled in accordance with the type of said transfer target determined by said determination unit.

6. An image forming apparatus according to claim 1, wherein a rotational speed of said image carrier is variably controlled in accordance with the type of said transfer target determined by said determination unit.

7. An image forming apparatus according to claim 1, wherein a convey speed of said transfer target is variably controlled in accordance with the type of said transfer target determined by said determination unit.

8. An image forming apparatus according to claim 1, wherein said image carrier and said intermediate transfer medium are rotatably provided, and said intermediate transfer medium is rotated with a predetermined speed difference from a rotational speed of said image carrier in accordance with the type of said transfer target determined by said determination unit.

9. An image forming apparatus according to claim 8, wherein said predetermined speed difference ranges from 1% to 5%.

10. An image forming apparatus comprising:

an image forming unit for forming an electrostatic latent image on an image carrier;

a developing unit for developing the electrostatic latent image on said image carrier with a developing solution obtained by dispersing developer particles in a solvent, thereby forming a visible image;

an intermediate transfer medium to which the visible image on said image carrier is to be transferred;

a transfer unit having a backup member abutted against said intermediate transfer medium, said backup member urging a transfer target against said intermediate transfer medium, thereby transferring the visible image on said intermediate transfer medium to said transfer target;

a determination unit for determining a type of said transfer target to which the visible image is to be transferred by said transfer unit; and a control unit for controlling said image forming unit in accordance with the type of said transfer target determined by said determination unit, so that at least a part a low-density image portion developed at said image forming unit differs in density from the image represented by the signal input to said image forming unit.

11. An image forming apparatus according to claim 10, wherein said control device controls a speed of said intermediate transfer medium, thereby variably controlling the contact time when said intermediate transfer medium is in contact with said transfer target.

12. An image forming apparatus according to claim 10, wherein said transfer unit has a transfer belt which comes into contact with said intermediate transfer medium to convey said transfer target, and a width with which said transfer belt is in contact with said intermediate transfer medium is changed, thereby variably controlling the contact time when said transfer target is in contact with said intermediate transfer medium.

13. An image forming apparatus comprising:

an image forming unit for forming an electrostatic latent image on an image carrier;

a developing unit for developing the electrostatic latent image on said image carrier with a developing solution obtained by dispersing developer particles in a solvent, thereby forming a visible image;

an intermediate transfer medium to which the visible image on said image carrier is to be transferred;

a transfer unit having a backup member abutted against said intermediate transfer medium, said backup member urging a transfer target against said intermediate transfer medium, thereby transferring the visible image on said intermediate transfer medium to said transfer target;

a determination unit for determining a type of said transfer target to which the visible image is to be transferred by said transfer unit; and a control unit for controlling said image forming unit in accordance with the type of said transfer target determined by said determination unit, so that a least part of a low-density image portion developed at said image forming unit differs in density from the image represented by the signal input to said image forming unit.

14. An image forming apparatus according to claim 13, wherein the type of sais transfer target determined by said determination unit is a surface roughness of the transfer target, and said control unit controls said image forming unit such that a low-density image portion developed at said image forming unit has a density higher then the image represented by the signal to said image forming unit when the transfer target has a large surface roughness.

15. An image forming method comprising the steps of:

forming an electrostatic latent image on an image carrier;

developing the electrostatic latent image on said image carrier with a developing solution obtained by dispersing developer particles in a solvent, thereby forming a visible image;

transferring the visible image on said image carrier to an intermediate transfer medium abutted against said image carrier;

urging a transfer target against said intermediate transfer medium with a backup member, thereby transferring the visibly image on said intermediate transfer medium to said transfer target;

determining a type of said tranfer target to which the visible image is to be transferred; and variably controlling a pressing force applied by said backup member to said transfer target determined in the step of determining the type of said transfer target.

16. An image forming method according to claim 15, wherein the step of controlling comprises variably controlling the pressing force of said backup member within a range of 1 $kg/cm_2$ to 50 $kg/cm_2$.

17. An image forming method according to claim 15, wherein the type of said transfer target determined in the step of determining the type of said transfer target is a surface roughness of the transfer target, and the pressing force of said backup member is increased when the transfer target has a large surface roughness.

18. An image forming method according to claim 15, wherein the visible image is transferred from said image carrier to said intermediate transfer medium with a pressure or a pressure and heat.

19. An image forming method according to claim 15, wherein an abutting force with which said intermediate transfer medium abuts against said image carrier is variably comtrolled in accordance with the type of said transfer target determined by said determination unit.

20. An image forming method according to claim 15, wherein a rotational speed of said image carrier is variably controlled in accordance with the type of said transfer target determined in the step of determining the type of the transfer target.

21. An image forming method according to claim 15, wherein a convey speed of said transfer target is variably controlled in accordance with the type of said transfer target determined in the step of determining the type of the transfer target.

22. An image forming method according to claim 15, wherein said image carrier and said intermediate transfer medium are rotatably provided, and said intermediate transfer medium is rotated with a predetermined speed difference from a rotational speed of said image carrier in accordance with the type of said transfer target determined by said determining step.

23. An image forming method according to claim 22, wherein said predetermined speed difference ranges from 1% to 5%.

24. An image forming apparatus using a developing solution obtained by dispersing developer particles in a solvent, comprising:

an image carrier rotatably held, for carrying an electrostatic latent image;

a developing unit for developing the electrostatic latent image on said image carrier with the developing solution, thereby forming a visible image; and a rotatable intermediate transfer medium abutting against said image carrier to transfer the visible image on said image carrier thereto, said intermediate transfer medium rotating with a speed difference of 1% to 5% from a rotational speed of said image carrier.

25. An image forming apparatus according to claim 24, wherein said intermediate transfer medium has an elastic layer on a surface thereof, the elastic layer having a thickness of 0.1 mm to 5 mm.

26. An image forming apparatus according to claim 24, wherein said intermediate transfer medium has an elastic layer on a surface thereof, the elastic layer having hardness of 1° to 70° (JIS-A).

27. An image forming apparatus according to claim 24, wherein said image carrier and said intermediate transfer medium abut against each other with a linear pressure of 0.1 kg/cm to 20 kg/cm.

28. An image forming apparatus according to claim 24, further comprising a backup member abutting against said intermediate transfer medium in a position different from a position where said image carrier abuts said intermediate transfer medium.

29. An image forming apparatus according to claim 28, wherein said backup member and said intermediate transfer medium abut against each other with a linear pressure of 0.2 kg/cm to 20 kg/cm.

30. An image forming apparatus according to claim 24, wherein said intermediate transfer medium has a mold release surface.

31. An image forming apparatus according to claim 24, further comprising an air blowing unit for blowing air to said image carrier downstream from said developing unit in a rotational direction of said image carrier.

* * * * *

UNITED STATES PATENT AND TRADEMARK OFFICE

CERTIFICATE OF CORRECTION

PATENT NO. : 6,389,242 B1
DATED : May 14, 2002
INVENTOR(S) : Takeshi Watanabe et al.

It is certified that error appears in the above-identified patent and that said Letters Patent is hereby corrected as shown below:

Title page,
Item [75], Inventors, please correct the inventor city to read -- Takeshi Watanabe, Ichikawa-shi, (JP) -- and please add the omitted inventors to read -- Koichi Ishii, Kawasaki-shi, (JP); Hitoshi Yagi, Yokohama-shi, (JP); Mitsunaga Saito, Ichikawa-shi, (JP); Masahiro Hosoya, Saitama-ken, (JP); Yasushi Shinjiyo, Kawasaki-shi, (JP); Haruhi Oooka, Yokohama-shi, (JP) --

Signed and Sealed this

Fourteenth Day of October, 2003

JAMES E. ROGAN
*Director of the United States Patent and Trademark Office*